United States Patent [19]

Takahashi et al.

[11] Patent Number: 4,906,342

[45] Date of Patent: Mar. 6, 1990

[54] PLATING BATH FOR ELECTRODEPOSITION OF ALUMINUM AND PLATING PROCESS MAKING USE OF THE BATH

[75] Inventors: Setsuko Takahashi, Misato; Isao Saeki, Niiza; Shoichiro Mori, Tsuchiura; Ida Kazuhiko, Ami, all of Japan

[73] Assignees: Nisshin Steel Co., Ltd.; Mitsubishi Petrochemical Co., Ltd., both of Tokyo, Japan

[21] Appl. No.: 340,491

[22] Filed: Apr. 19, 1989

[30] Foreign Application Priority Data

Apr. 26, 1988 [JP] Japan ..... 63-103099
Feb. 17, 1989 [JP] Japan ..... 1-37997

[51] Int. Cl.[4] ..... C25D 3/44
[52] U.S. Cl. ..... 204/58.5
[58] Field of Search ..... 204/39, 58.5

[56] References Cited

U.S. PATENT DOCUMENTS

| | | | |
|---|---|---|---|
| 2,446,331 | 8/1948 | Hurley | 204/14 |
| 2,446,349 | 8/1948 | Wier et al. | 204/14 |
| 2,446,350 | 8/1948 | Wier | 204/14 |
| 4,747,916 | 5/1988 | Kato et al. | 204/58.5 |

OTHER PUBLICATIONS

R. Suchentrunk, *Corrosion Protection by Electro-Deposited Aluminum*, Z. Werkstofftech, vol. 12, 1981, pp. 190–206.

D. E. Couch et al., *A. Hydride Bath for the Electrodeposition of Aluminum*, Journal of Electrochemical Society, vol. 99, No. 6 Jun. 1952, pp. 234–244.

*Primary Examiner*—T. M. Tufariello
*Attorney, Agent, or Firm*—Foley & Lardner, Schwartz, Jeffery, Schwaab, Mack, Blumenthal & Evans

[57] ABSTRACT

In the plating for electrodeposition of aluminum using a non-aqueous solution, a plating bath is prepared to comprise a low-melting plating bath, which comprises a molten mixture comprising an aluminum halide and a dialkyl-and/or trialkylpyridinium halide represented by the following formula:

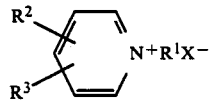

wherein $R^1$ represents an alkyl group having 1 to 12 carbon atoms, $R^2$ represents a hydrogen atom or an alkyl group having 1 to 6 carbon atoms, $R^3$ represents an alkyl group having 1 to 6 carbon atoms, and X represents a halogen atom; and said alkyl groups each refer to a straight-chain hydrocarbon group, a branched hydrocarbon group, an alicyclic hydrocarbon group, or any of these further partly containing an aromatic hydrocarbon group, by which the bath life, operability in handling, conductivity, and current efficiency can be improved.

15 Claims, No Drawings

PLATING BATH FOR ELECTRODEPOSITION OF ALUMINUM AND PLATING PROCESS MAKING USE OF THE BATH

BACKGROUND OF THE INVENTION

This invention relates to a plating bath for electrodeposition of aluminum, having a long bath life, also having a good operability in handling, and yet having a high current efficiency and conductivity, and a plating process making use of the bath.

Plating for electrodeposition of aluminum can be carried out with difficulty using a plating bath of an aqueous solution type, because of a large affinity of aluminum for oxygen and a lower potential thereof than hydrogen. For this reason, the plating for electrodeposition of aluminum has been hitherto carried out using a plating bath of a non-aqueous solution type, in particular, a plating bath of an organic solvent type.

This plating bath of an organic solvent type typically includes baths comprising $AlCl_3$ and $LiAlH_4$ or LiH dissolved in ether, and those comprising $AlCl_3$ and $LiAlH_4$ dissolved in tetrahydrofuran (see, for example, D.E. Couch et al. Electrochem., Vol. 99, (6), p.234).

All of these plating baths, however, contain very active $LiAlH_4$ or LiH in the bath, and hence it may react with oxygen or water which may exist therein, to decompose, resulting in a lowering of current efficiency and also a shortened bath life. They also have the problem that they use organic solvents having so a low boiling point that they are highly in danger of explosion or burning. As other plating baths of an organic solvent type, a plating bath has been proposed, comprising triethylaluminum and NaF dissolved in toluene (R. Suchentrunk, X. Werkstofftech., Vol. 12, p.190). In this instance also, however, there is a problem in handling the triethylaluminum, which is highly dangerous, and it is considered difficult to put the bath into practical use in an industrial scale.

As discussed in the above, the conventional techniques have succeeded for the time being in settling the technical subject that the plating for electrodeposition of aluminum is carried out, but, because of employment of chemical substances which are difficult to handle, they all have disadvantages in the bath life and operability, leaving problems in widely and commonly using them as techniques for practical use.

SUMMARY OF THE INVENTION

A first object of the present invention is to provide a plating bath for electrodeposition of aluminum, that has a long bath life and promises the safety in handling, and a plating process making use of the bath.

Another object of the present invention is to provide a plating bath for electrodeposition of aluminum, that has a high current efficiency and conductivity.

The present inventors made intensive studies to develop a new plating bath for electrodeposition of aluminum and plating process making use of the bath, that can solve the problems in the prior art, and as a result found that the problems can be solved by using a plating bath comprising a molten mixture comprising an aluminum halide and dialkyl- and/or trialkylpyridinium halide(s) (or at least one of a dialkylpyridinium halide and a trialkylpyridinium halide).

The aluminum halide and the dialkyl- and/or trialkylpyridinium halide(s), when mixed and melted, are made into a low-melting molten salt bath that turns into a liquid even at room temperature under a wide compositional range. This plating bath contains no chemical substances which are chemically active, so that it can have a long bath life and can be free from dangers such as explosion and burning, resulting in good operability in handling. The bath also undergoes electrolytic dissociation into di(tri)alkylpyridinium cations of quaternary ammonium ions and Al complex anions in a low-temperature molten state, showing a reasonably high ionic conductivity, so that the plating can be carried out in a high current efficiency even at a high current density of 50 $A/dm^2$.

Here, the dialkyl- and/or trialkylpyridinium halide(s) used in the plating bath is a compound represented by the following general formula:

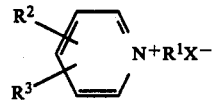

wherein $R^1$ represents an alkyl group having 1 to 12 carbon atoms, $R^2$ represents a hydrogen atom or an alkyl group having 1 to 6 carbon atoms, $R^3$ represents an alkyl group having 1 to 6 carbon atoms, and X represents a halogen atom; and said alkyl groups each refer to a straight-chain hydrocarbon group, a branched hydrocarbon group, an alicyclic hydrocarbon group, or any of these further partly containing an aromatic hydrocarbon group.

DESCRIPTION OF THE PREFERRED EMBODIMENTS

To show specific examples of these di(tri)alkylpyridinium salts, they include 1,2-dimethylpyridinium chloride, 1-ethyl-2-methylpyridinium chloride, 1-ethyl-2-methylpyridinium bromide, 1-ethyl-2-methylpyridinium iodide, 1-ethyl-2-methylpyridinium fluoride, 1-n-butyl-2-methylpyridinium chloride, 1-isobutyl-2-methylpyridinium chloride, 1-n-octyl-2-methylpyridinium chloride, 1-benzyl-2-methylpyridinium chloride, 1-ethyl-3-methylpyridinium chloride, 1-ethyl-3-methylpyridinium bromide, 1-cyclohexyl-3-methylpyridinium bromide, 1-ethyl-2-ethylpyridinium chloride, 1-butyl-2-ethylpyridinium chloride, 1-ethyl-3-methylpyridinium bromide, 1-ethyl-3-phenylpyridinium bromide, 1-ethyl 2,4-dimethylpyridinium chloride, 1-ethyl-2,6-dimethylpyridinium chloride, and 1-n-butyl-2,4-dimethylpyridinium chloride.

The aluminum halide refers to a compound represented by the general formula: $AlX_3$ (X is halogen), and specifically includes $AlF_3$, $AlCl_3$, $AlBr_3$ and $AlI_3$.

These aluminum halide and dialkyl- and/or trialkylpyridinium halide(s) may be mixed in the proportion of from 20 to 80 mol % of the aluminum halide and from 20 to 80 mol % of the dialkyl- and/or trialkylpyridinium halide(s), thereby being made into a low-melting plating solution. For example, in a plating solution comprising a mixture of aluminum chloride with a 1-ethyl-3-methylpyridinium halide, it can be liquid at room temperature over the whole range of from 20 to 80 mol % of the aluminum chloride, showing a reasonably low viscosity.

However, to efficiently carry out the plating for electrodeposition of aluminum, the aluminum halide may be mixed in the proportion of from 50 to 75 mol %, and more preferably from 55 to 70 mol %; and the dialkyl-and/or trialkylpyridinium halide(s), from 25 to 50 mol %, and more preferably from 30 to 45 mol %. In a system containing the aluminum halide in an excessively small proportion, a reaction presumed to be decomposition of dialkyl- and/or trialkylpyridinium cations may take place in carrying out the electroplating, and, in a system containing the aluminum halide in an excessively large proportion, the viscosity of the plating bath tends to increase, undesirably.

The plating bath of the present invention is prepared by mixing and melting the aluminum halide and an N-alkylpolyalkylpyridinium halide, and in this instance can be prepared through the two steps described below.

First step:

An alkyl halide and a polyalkylpyridine are charged together with a reaction solvent in an autoclave provided with a stirrer, and heated to 30 to 200° C., and more preferably 50 to 150° C., to carry out reaction to form them into a quaternary ammonium salt. After the reaction, the solvent and unreacted matters are removed to prepare an Nalkylpolyalkylpyridinium halide. The reaction solvent that can be used here includes hydrocarbons such as benzene, toluene and hexane, and polar solvents such as water, methanol, ethanol, tetrahydrofuran, dimethylformamide and dimethyl sulfoxide.

Second step:

The N-alkylpolyalkylpyridinium halide prepared in the first step and an aluminum halide are mixed in the given proportion and then heated in the atmosphere of an inert gas, or mixed under heating in a state that both are suspended in a suitable solvent, followed by removal of solvent, thus making a plating solution. In either instance, considerable heat generation accompanies the mixing of them, and hence it is necessary to take care not to cause reckless increase in temperature.

The plating for electrodeposition of aluminum using the plating bath of the present invention is carried out in a dry, oxygen-free atmosphere from the viewpoints of maintaining the stability of the plating bath and improving plating quality. As for plating conditions, the plating may be carried out using direct current or pulse current at a high temperature of from 0 to 300° C. and at a current density of from 0.01 to 50 A/dm$^2$, so that the plating can be carried out uniformly with a good current efficiency. An excessively low bath temperature enables no uniform plating, and an excessively high bath temperature may cause the decomposition of quaternary ammonium cations, non-uniform coatings, and further a lowering of current efficiency, undesirably.

In instances in which a strip or the like is continuously plated, it is required to supply Al ions in a bath so that the Al ion concentration in the bath may be kept in a given range. In such instances, however, if the anode is comprised of a soluble anode made of aluminum, the Al ions can be automatically supplied in accordance with the amount of electrification, so that the Al ion concentration can be kept in a given range without supplying the aluminum halide, and also the bath composition may not loss its balance.

In instances in which the plating is carried out efficiently at low temperatures, a method is effective in which an organic solvent is added to lower the viscosity of the plating bath. In such instances, an inert solvent such as toluene, xylene, benzene or chlorobenzene may preferably be added as the organic solvent, and may be added in an amount of usually from 5 to 100 vol. %, so that the plating efficiency can be improved.

For the purpose of increasing the conductivity of the plating bath or making coatings uniform, it is also effective to add an alkali metal and/or alkaline earth metal halide(s). The alkali metal halide and alkaline earth metal halide in this instance may include LiCl, NaCl, NaF and $CaCl_2$, and these compounds are added in the plating bath in an amount of usually from 0.1 to 30 mol %.

EXAMPLES

Example 1

In an autoclave made of stainless steel, 1.0 mol (93.1 g) of 3-picoline and 1.1 mol (119.9 g) of ethyl bromide, and 100 g of methanol as a solvent were charged, and then reacted at 100° C. for 8 hours with stirring. Using a rotary evaporator, the solvent and unreacted matters were evaporated from the reaction mixture to obtain 200.1 g of a solid product. This solid product was found to be 1-ethyl-3-methylpyridinium bromide, with the reaction yield of 99 mol % based on 3-picoline.

Next, 0.10 mol (20.2 g) of the 1-ethyl-3-methylpyridinium bromide obtained was put in a reaction vessel made of glass in a nitrogen atmosphere, into which 0.20 mol (26.67 g) of aluminum chloride was fed little by little. The feeding thereof caused reaction with the 1-ethyl-3-methylpyridinium bromide at their solid interfaces, and fusion gradually proceeded, accompanied, however, with considerable heat generation at the initial stage of the reaction, and accordingly the aluminum chloride was fed in its whole amount while taking care so as for the reaction temperature not to exceed 70° C. The resulting mixture was liquid at room temperature, and had a conductivity of 10.3 mS/cm (25° C).

In this system, the mixing molar ratio (A/B) of aluminum chloride (A) to 1-ethyl-3-methylpyridinium bromide (B) was varied from 1 to 2, but the mixture was kept liquid at room temperature within the whole molar ratio, and showed a high conductivity at a low temperature as shown by the conductivities in Table 1. Taking account of these, the mixture can be deemed to be excellent as the plating bath for electrodeposition of aluminum.

TABLE 1

Relationship between molar ratio and conductivity (mS/cm, 25° C.).

| Temperature (°C.) | Molar ratio 1.0 | 1.5 | 2.0 |
|---|---|---|---|
| 25 | 14.5 | 11.4 | 10.3 |
| 30 | 16.6 | 13.3 | 11.7 |
| 40 | 21.1 | 17.0 | 14.8 |
| 50 | 26.9 | 21.7 | 18.6 |
| 60 | 33.2 | 26.5 | 22.6 |
| 70 | 39.6 | 31.8 | 26.8 |

Examples 2 to 8

By the same reaction procedures as Example 1, 1-ethyl-3-methylpyridinium chloride was synthesized from 3-picoline and ethyl chloride (Example 2); 1-n-butyl-3-methylpyridinium chloride, from 3-picoline and n-butyl chloride (Example 3); 1-benzyl-3-methylpyridinium chloride, from 3-picoline and benzyl chloride (Example 4); 1-ethyl-3,5-dimethylpyridinium bromide, from 3,5-lutidine and ethyl bromide (Example 5); 1-ethyl-3,5-dimethylpyridinium chloride, from 3,5-lutidine and ethyl chloride (Example 6); respectively.

These di(tri)alkylpyridinium salts were mixed with aluminum chloride in the same manner as Example 1 to make plating baths for electrodeposition of aluminum, in which the molar ratio of aluminum chloride to di(-tri)alkylpyridinium salts was 2. Also, using aluminum bromide in place of aluminum chloride, prepared were plating baths for electrodeposition of aluminum, in which the molar ratio of 1-ethyl-3-methylpyridinium bromide of Example 1 or 1-ethyl-3,5-dimethylpyridinium bromide of Example 5 to the aluminum bromide was 2 (Examples 7 and 8).

The plating baths thus prepared had the conductivity as shown in Table 2.

TABLE 2

| Example No. | Aluminum halide | Conductivity of each plating bath: Di(tri)alkylpyridinium halide | Temp. (°C.) | Conductivity (mS/cm) |
|---|---|---|---|---|
| 2 | $AlCl_3$ | 1-Ethyl-3-methylpyridinium chloride | 25 | 11.0 |
| | | | 50 | 19.8 |
| 3 | $AlCl_3$ | 1-n-Butyl-3-methylpyridinium chloride | 25 | 6.7 |
| 4 | $AlCl_3$ | 1-Benzyl-3-methylpyridinium chloride | 50 | 5.8 |
| 5 | $AlCl_3$ | 1-Ethyl-3,5-dimethylpyridinium bromide | 25 | 7.5 |
| | | | 50 | 13.6 |
| 6 | $AlCl_3$ | 1-Ethyl-3,5-dimethylpyridium chloride | 25 | 8.1 |
| | | | 50 | 14.5 |
| 7 | $AlBr_3$ | 1-Ethyl-3-methylpyridinium bromide | 50 | 10.1 |
| 8 | $AlBr_3$ | 1-Ethyl-3,5-dimethylpyridinium bromide | 50 | 7.3 |

Note:
The molar ratio of the aluminum halide to the di(tri)alkylpyridinium salt was 2 in each example.

Examples 9 to 18

A cold rolled sheet with a sheet thickness of 0.5 mm was subjected to solvent vapor cleaning, alkali degreasing, pickling, and so forth in conventional manners, followed by drying, and the sheet thus treated was immediately immersed in the plating bath of Examples 1 to 8 each, previously kept in an $N_2$ atmosphere. Thereafter, the cold rolled sheet was plated with aluminum using a direct current, setting the cold rolled sheet serving as the cathode, and an aluminum sheet (purity: 99.99 %; sheet thickness: 1 mm) as the anode. The relationship between the plating bath composition, electrolysis conditions, and the resulting aluminum-plated steel sheets is shown in Table 3.

TABLE 3

| Example No. | Plating bath composition: Aluminum halide | Di(tri)alkylpyridinium halide |
|---|---|---|
| 9 | $AlCl_3$ 66.7 mol % | 1-Ethyl-3-methylpyridinium bromide 33.3 mol % |
| 10 | $AlCl_3$ 60.0 mol % | 1-Ethyl-3-methylpyridinium bromide 40.0 mol % |
| 11 | $AlCl_3$ 66.7 mol % | 1-Ethyl-3-methylpyridinium chloride 33.3 mol % |
| 12 | $AlCl_3$ 66.7 mol % | 1-Ethyl-3-methylpyridinium chloride 33.3 mol % |
| 13 | $AlCl_3$ 66.7 mol % | 1-n-Butyl-3-methylpyridinium chloride 33.3 mol % |
| 14 | $AlCl_3$ 66.7 mol % | 1-Benzyl-3-methylpyridinium chloride 33.3 mol % |
| 15 | $AlCl_3$ 66.7 mol % | 1-Ethyl-3,5-dimethylpyridinium bromide 33.3 mol % |
| 16 | $AlCl_3$ 66.7 mol % | 1-Ethyl-3,5-dimethylpyridinium chloride 33.3 mol % |
| 17 | $AlBr_3$ 66.7 mol % | 1-Ethyl-3-methylpyridinium bromide 33.3 mol % |
| 18 | $AlBr_3$ 66.7 mol % | 1-Ethyl-3,5-dimethylpyridinium bromide 33.3 mol % |

TABLE 3 (Cont'd laterally)

| Example No. | Electrolysis conditions: Bath temp. (°C.) | Current density (A/dm²) | Electrolysis time (min) | Current efficiency (%) | Coatings: Thickness (μm) | State of crystal | Workability |
|---|---|---|---|---|---|---|---|
| 9 | 25 | 10 | 10 | 97 | 20 | Dense | Good |
| 10 | 50 | 30 | 3 | 96 | 18 | Dense | Good |
| 11 | 25 | 10 | 5 | 97 | 10 | Dense | Good |
| 12 | 50 | 20 | 2.5 | 95 | 10 | Dense | Good |
| 13 | 25 | 5 | 20 | 99 | 20 | Dense | Good |
| 14 | 50 | 10 | 10 | 98 | 20 | Dense | Good |
| 15 | 25 | 1 | 50 | 100 | 10 | Dense | Good |
| 16 | 25 | 1 | 50 | 99 | 10 | Dense | Good |
| 17 | 50 | 5 | 20 | 98 | 20 | Dense | Good |
| 18 | 50 | 5 | 20 | 98 | 20 | Dense | Good |

Example 19

In the plating bath comprising aluminum chloride and 1-ethyl-3-methylpyridinium bromide (molar ratio: 2:1), prepared in Example 1, a toluene solvent was added in the proportion of 1:1 (volume ratio) to prepare a plating bath having a lowered viscosity. This plating bath had a conductivity of 17.8 mS/cm (25° C.), which was made 70 % larger than the conductivity of the plating bath of Example 1.

Next, using this plating bath, a cold rolled sheet was electroplated with aluminum according to the plating procedures in Examples 9 to 18 under conditions of a bath temperature of 25° C., a current density of 20 A/dm² and an electrolysis time of 2.5 minutes. As a result, a very dense coating of about 10 μm thick was formed on the surface of the cold rolled sheet, with a current efficiency of 99 %.

Example 20

In the plating bath comprising aluminum chloride and 1-ethyl-3-methylpyridinium chloride (molar ratio: 2:1), prepared in Example 3, NaCl was added in an amount of 5 mol % based on the amount of 1-ethyl-3-methylpyridinium chloride to prepare a plating bath. Using this plating bath, a cold rolled sheet was electroplated with aluminum according to the plating procedures in Examples 9 to 18 under conditions of a bath temperature of 50° C., a current density of 10 A/cm² and an electrolysis time of 5 minutes. As a result, a very dense glossy coating of about 10 μm thick was formed on the cold rolled sheet, with a current efficiency of 98 %.

What is claimed is:

1. A plating bath for electrodeposition of aluminum, comprising a molten mixture comprising an aluminum halide and at least one of a dialkylpyridinium halide and a trialkylpyridinium halide, represented by the following formula:

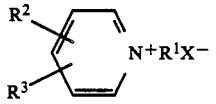

wherein $R^1$ represents an alkyl group having 1 to 12 carbon atoms, $R^2$ represents a hydrogen atom or an alkyl group having 1 to 6 carbon atoms, $R^3$ represents an alkyl group having 1 to 6 carbon atoms, and X represents a halogen atom; and said alkyl groups each refer to a straight-chain hydrocarbon group, a branched hydrocarbon group, an alicyclic hydrocarbon group, or any of these further partly containing an aromatic hydrocarbon group.

2. The plating bath for electrodeposition of aluminum according to claim 1, wherein said plating bath comprises a molten mixture comprising from 20 to 80 mol % of the aluminum halide and from 20 to 80 mol % of at least one of the dialkylpyridinium halide and trialkylpyridinium halide.

3. The plating bath for electrodeposition of aluminum according to claim 1, wherein from 0.1 to 30 mol % of at least one of an alkali metal halide and an alkaline earth metal halide is further added in said plating bath.

4. The plating bath for electrodeposition of aluminum according to claim 2, wherein from 0.1 to 30 mol % of at least one of an alkali metal halide and an alkaline earth metal halide is further added in said plating bath.

5. The plating bath for electrodeposition of aluminum according to claim 1, wherein an organic solvent is further added.

6. The plating bath for electrodeposition of aluminum according to claim 2, wherein an organic solvent is further added.

7. The plating bath for electrodeposition of aluminum according to claim 3, wherein an organic solvent is further added.

8. A plating process for electrodeposition of aluminum, comprising carrying out plating by use of a plating bath for electrodeposition of aluminum, comprising a molten mixture comprising an aluminum halide and at least one of a dialkylpyridinium halide and a trialkylpyridinium halide, represented by the following formula:

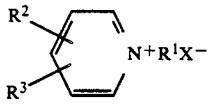

wherein $R^1$ represents an alkyl group having 1 to 12 carbon atoms, $R^2$ represents a hydrogen atom or an alkyl group having 1 to 6 carbon atoms, $R^3$ represents an alkyl group having 1 to 6 carbon atoms, and X represents a halogen atom; and said alkyl groups each refer to a straight-chain hydrocarbon group, a branched hydrocarbon group, an alicyclic hydrocarbon group, or any of these further partly containing an aromatic hydrocarbon group, in a dry oxygen-free atmosphere, using a direct current or pulse current, at a bath temperature of from 0 to 300° C. and a current density of from 0.01 to 50 A/dm$^2$.

9. The plating process for electrodeposition of aluminum according to claim 8, wherein the plating is carried out by use of a plating bath, comprising a molten mixture comprising from 20 to 80 mol % of the aluminum halide and from 20 to 80 mol % of at least one of the dialkylpyridinium halide and trialkylpyridinium halide, in a dry oxygen-free atmosphere, using a direct current or pulse current, at a bath temperature of from 0 to 300° C. and a current density of from 0.01 to 50 A/dm$^2$.

10. The plating process for electrodeposition of aluminum according to claim 8, wherein the plating is carried out by use of said plating bath, in which from 0.1 to 30 mol % of at least one of an alkali metal halide and an alkaline earth metal halide is further added, in a dry oxygen-free atmosphere, using a direct current or pulse current, at a bath temperature of from 0 to 300° C. and a current density of from 0.01 to 50 A/dm$^2$.

11. The plating process for electrodeposition of aluminum according to claim 9, wherein the plating is carried out by use of said plating bath, in which from 0.1 to 30 mol % of at least one of an alkali metal halide and an alkaline earth metal halide is further added, in a dry oxygen-free atmosphere, using a direct current or pulse current, at a bath temperature of from 0 to 300° C. and a current density of from 0.01 to 50 A/dm$^2$.

12. The plating process for electrodeposition of aluminum according to claim 8, wherein the plating is carried out by use of said plating bath, in which an organic solvent is further added, in a dry oxygen-free atmosphere, using a direct current or pulse current, at a bath temperature of from 0 to 300° C. and a current density of from 0.01 to 50 A/dm$^2$.

13. The plating process for electrodeposition of aluminum according to claim 9, wherein the plating is carried out by use of said plating bath, in which an organic solvent is further added, in a dry oxygen-free atmosphere, using a direct current or pulse current, at a bath temperature of from 0 to 300° C. and a current density of from 0.01 to 50 A/dm$^2$.

14. The plating process for electrodeposition of aluminum according to claim 10, wherein the plating is carried out by use of said plating bath, in which an organic solvent is further added, in a dry oxygen-free atmosphere, using a direct current or pulse current, at a bath temperature of from 0 to 300° C. and a current density of from 0.01 to 50 A/dm$^2$.

15. The plating process for electrodeposition of aluminum according to claim 8, wherein the plating is carried out by using an anode made of aluminum.

* * * * *